US011747100B2

(12) United States Patent
Salinas et al.

(10) Patent No.: US 11,747,100 B2
(45) Date of Patent: Sep. 5, 2023

(54) TUNABLE RECOIL ASSEMBLY

(71) Applicant: AXTS INC, Redmond, OR (US)

(72) Inventors: Anibal Salinas, Redmond, CA (US); Joshua A. Underwood, Redmond, CA (US)

(73) Assignee: AXTS, INC., Redmond, OR (US)

( * ) Notice: Subject to any disclaimer, the term of this patent is extended or adjusted under 35 U.S.C. 154(b) by 0 days.

(21) Appl. No.: 17/732,470

(22) Filed: Apr. 28, 2022

(65) Prior Publication Data

US 2023/0012703 A1 Jan. 19, 2023

Related U.S. Application Data

(60) Provisional application No. 63/214,659, filed on Jun. 24, 2021, provisional application No. 63/184,551, filed on May 5, 2021.

(51) Int. Cl.
*F41A 3/80* (2006.01)

(52) U.S. Cl.
CPC ..... *F41A 3/80* (2013.01)

(58) Field of Classification Search
CPC ..... F41A 3/80; F41A 3/82; F41A 3/86
USPC ..... 89/14.3, 199; 42/1.06
See application file for complete search history.

(56) References Cited

U.S. PATENT DOCUMENTS 4,344,352 A * 8/1982 Yates ..... F41A 25/22 89/198
4,485,723 A * 12/1984 Sarony ..... F41A 3/86 89/198
5,054,368 A * 10/1991 Wentzel ..... F41A 3/86 89/196
5,127,310 A * 7/1992 Lishness ..... F41A 3/86 42/108
5,392,689 A * 2/1995 Buzzeo ..... F41A 3/86 89/196
9,970,722 B1 * 5/2018 Babb ..... F41A 3/82
2002/0046644 A1 * 4/2002 Weldle ..... F41A 25/26 89/199
2012/0167425 A1 * 7/2012 Buschow ..... F41A 25/14 42/14
2013/0092018 A1 * 4/2013 Pflaumer ..... F41A 3/82 89/194
2017/0176122 A1 6/2017 Underwood
2018/0073825 A1 * 3/2018 Zukowski ..... F41C 3/00
(Continued)

OTHER PUBLICATIONS

Strike Industries, "Modular Guide Rod for GLOCK™ GEN3", On-line catalog, Santa Ana, California, Website: https://www.strikeindustries.com/si-g-mgr-s.html; available at least as early as May 4, 2021.

(Continued)

*Primary Examiner* — Bret Hayes
(74) *Attorney, Agent, or Firm* — Schwabe Williamson & Wyatt

(57) ABSTRACT

In some embodiments, a tunable recoil assembly is provided. The tunable recoil assembly may include a guide rod having a front end, a length, and a rear end; one or more springs around the length of the guide rod; and a removable cap releasably coupled to one of the ends of the guide rod. In some embodiments, the removable cap may be retained using a spring force, and may be slidingly coupled, twistingly coupled, or otherwise releasably coupled to the one of the ends of the guide rod.

43 Claims, 15 Drawing Sheets

(56) References Cited

U.S. PATENT DOCUMENTS

| | | | | |
|---|---|---|---|---|
| 2021/0239415 | A1* | 8/2021 | Bray | F41A 3/82 |
| 2022/0136787 | A1* | 5/2022 | Caudle | F41A 3/62 89/191.01 |
| 2022/0221237 | A1* | 7/2022 | Nelson | F41C 3/00 |

OTHER PUBLICATIONS

Waltherforums.Com, https://www.waltherforums.com/cdn-cgi/image/format=auto,onerror=redirect,width=1920,height=1920,fit=scale-down/https://www.waltherforums.com/attachments/20220421_130343-jpg.104095/, Feb. 16, 2021.

WaltherArms.com, Tungsten Guide Rod RSA 50N, https://waltherarms.com/tungsten-guide-rod-rsa-50n, Feb. 16, 2021.

* cited by examiner

FIG. 1 (background)

TUNABLE RECOIL ASSEMBLY

PRIORITY

This application claims priority to U.S. Provisional Application No. 63/184,551 filed on May 5, 2021, and U.S. Provisional Application No. 63/214,659 filed on Jun. 24, 2021, each of which is incorporated by reference herein.

BACKGROUND

Typical firearms propel a bullet or other type of projectile through the expansion of gas within a firearm barrel. The majority of the gas may be expelled out of the front of the firearm barrel together with the bullet, in a forward direction.

Some firearms have slides and recoil assemblies. In these firearms, the expulsion of this gas in the forward direction propels the slide rearward and also compresses recoil spring(s) in the recoil assembly.

Since spring rate affects the timing during the recoil and feeding cycle, it is optimal to balance recoil spring strength with the magnitude of the force applied to the slide. Spring strength is measured in weight, e.g., an 18 pound spring, an 11 pound spring, etc. If the recoil spring weight is too great for the magnitude of the force applied to the slide, the firearm may not cycle reliably and can cause failures in extraction and ejection. If the recoil spring weight is too weak, the slide will not have sufficient energy to return to its full forward position and lockup.

A number of factors can affect the magnitude of the force applied to the slide. Light bullet loads, such as those used in target shooting, may result in a reduced magnitude of the force applied to the slide. Some firearm accessories may modify the way gas is expelled out of the front of the firearm, which can also result in a reduced magnitude of the force applied to the slide. Or, the operator of the firearm may be a person with less grip strength, causing more of the energy to be absorbed in the wrist, causing a lower slide speed. For these and other reasons, it is advantageous to be able to "tune" the recoil spring rate to a given set of conditions (ammunition used, firearm accessories used, user preference, etc.).

DETAILED DESCRIPTION

Figure 1:
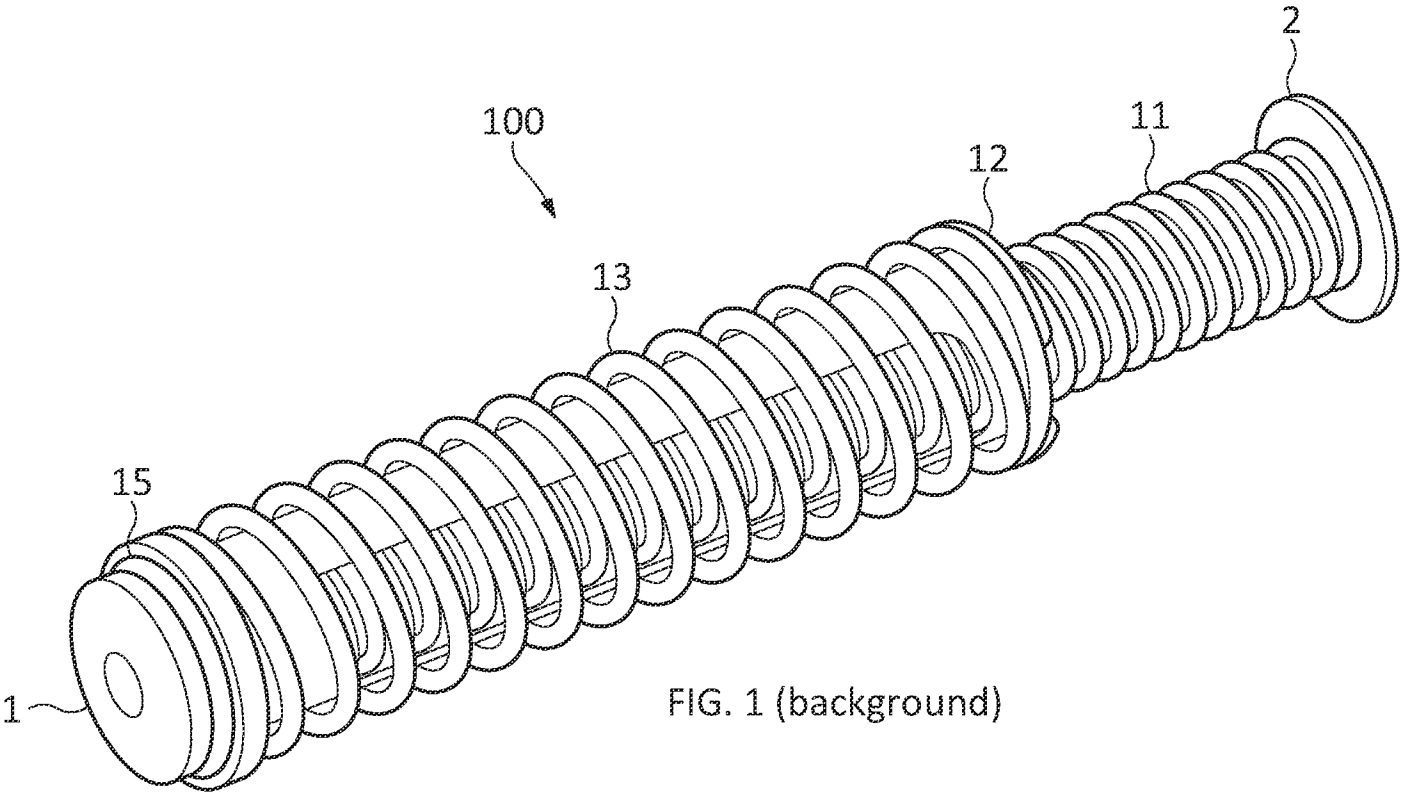
FIG. 1 is an isometric view of a dual spring recoil assembly.

FIG. 1 is an isometric view of a dual spring recoil assembly 100. Dual spring systems similar to assembly 100 may be used in Glocks® (including, but not limited to, generation four and generation five Glocks®), or other pistols by this or another manufacturer. The assembly 100 includes a polymer guide rod having a first end including the integrated polymer cap 1 (i.e. built-in—molded as part of the polymer guide rod) and a second end having a tail cap 2 riveted thereto. An inner spring 11 is around the guide rod. An outer spring 13 is around a spring sleeve 12, which is around the inner spring 11. The outer spring 13 engages a bushing 15.

The dual spring recoil assembly 100 is not modular. Therefore, for tuning a generation four or five Glock®, an operator typically uses a slide lug adapter that allows a generation three recoil assembly to be used with a generation four or five Glock®. Although the generation three recoil assembly has a single flat wire spring (and thus may have more recoil impulse than a recoil assembly with more than one spring and/or a round wire spring), operators may be willing to make this tradeoff to enable using a different recoil spring with a preferred spring weight (e.g., less than an eighteen pound spring weight).

Figure 2:
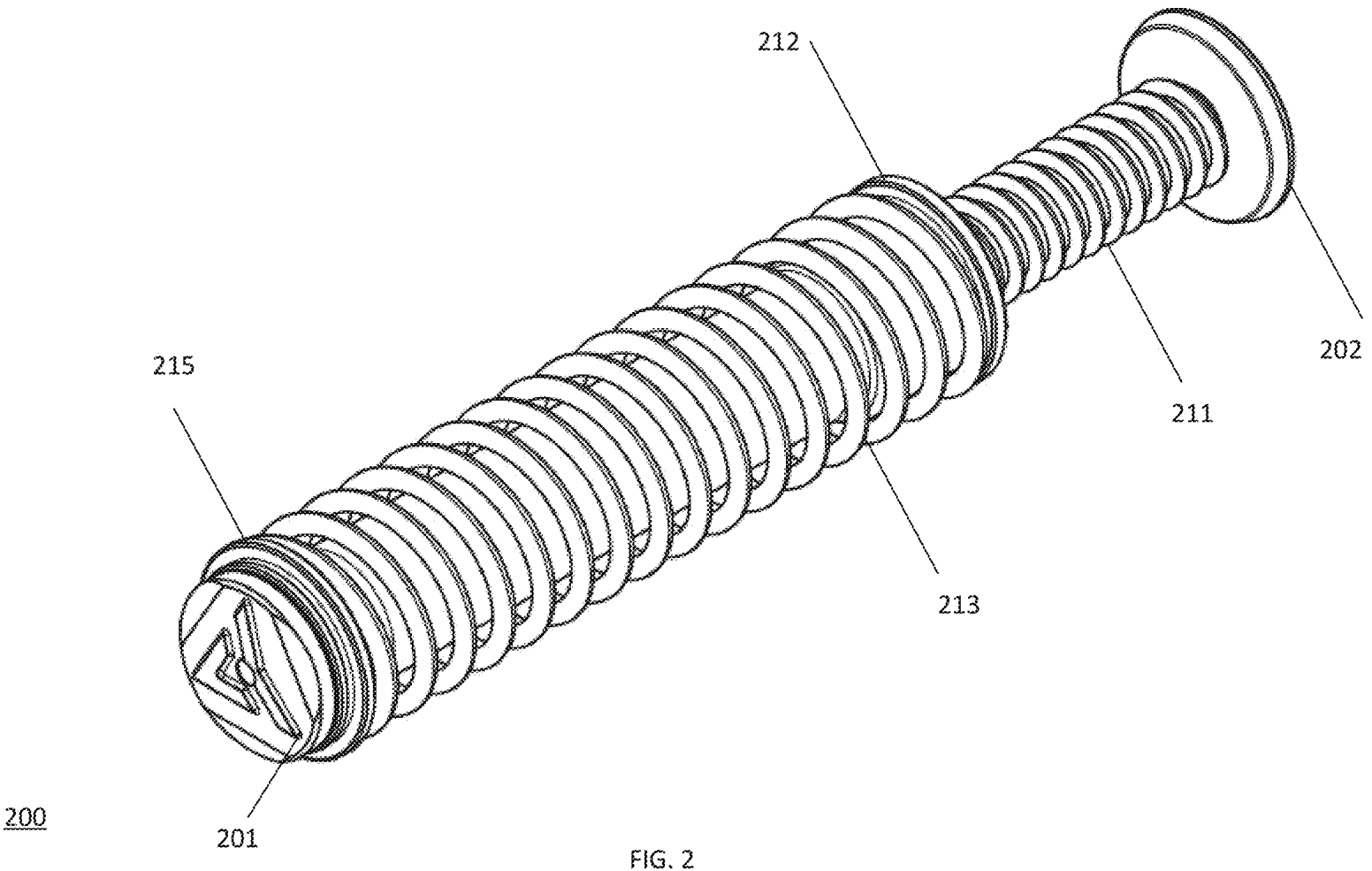
FIG. 2 is an isometric view of a tunable dual spring recoil assembly, according to various embodiments.

FIG. 2 is an isometric view of a tunable dual spring recoil assembly 200. The assembly 200 may be used in place of the assembly 100 (e.g., may have the same or similar outside dimensions). The assembly 200 includes a guide rod having a first end with a removable cap 201 coupled thereto and a second end with a tail cap 202 (the guide rod 214 is shown in FIG. 3B). Referring again to FIG. 2, in contrast to the assembly 100 (FIG. 1) where the polymer cap 1 is integrally formed with the polymer guide rod, the removable cap 201 is releasably attached to the guide rod. The tail cap 202 may be connected (e.g., non-releasably coupled) to the guide rod, e.g., press fit into a hole 302 (FIG. 3) formed in an end of the guide rod 214 (FIG. 3), or otherwise fixably attached thereto.

Referring again to FIG. 2, when the removable cap 201 is detached, the bushing 215 and the outer spring 213 may be slidingly removed from the guide rod. A different outer spring may be reattached with the bushing 215 in combination with the same inner spring 211 to provide a firearm slide assembly with a different total spring weight.

Figure 3A:
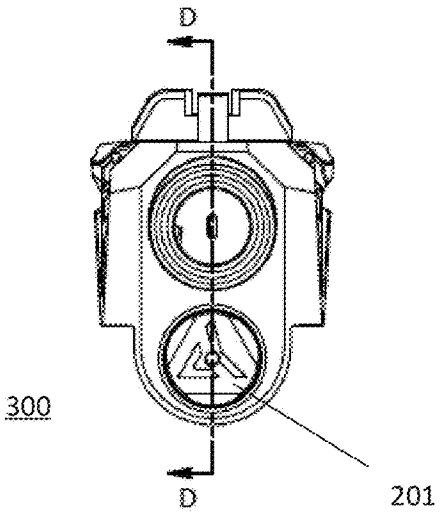
FIG. 3A illustrates a front view of a firearm slide assembly employing the tunable dual spring recoil assembly of FIG. 2, according to various embodiments.
Figure 3B:
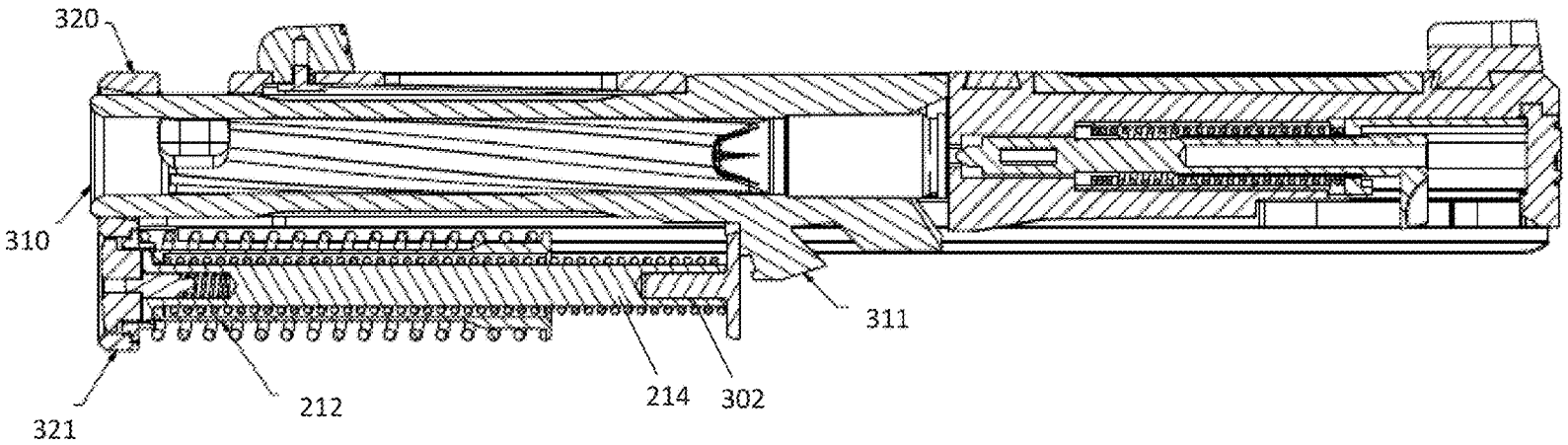
FIG. 3B illustrations a sectional view taken along section line D of FIG. 3A.

FIG. 3A illustrates a front view of a firearm slide assembly 300 employing the tunable dual spring recoil assembly 200 of FIG. 2, according to various embodiments. FIG. 3B illustrates a sectional view along section line D of FIG. 3A. The firearm slide assembly 300 includes a barrel 310 and the slide 320. The assembly 200 is located in front of a barrel lug 311 of the barrel 310 and is coupled to a slide lug 321 (also called a recoil lug) of the slide 320.

Figure 4A:
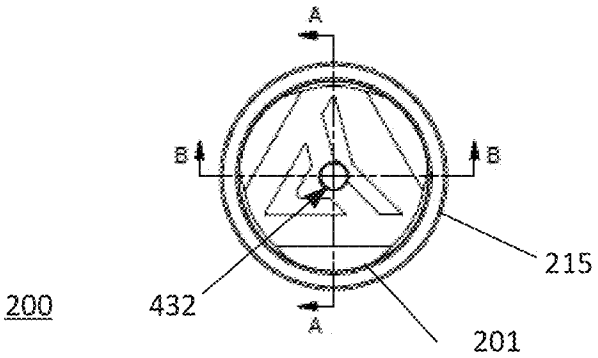
FIG. 4A illustrates a front view of the recoil assembly of FIG. 2.
Figure 4B:
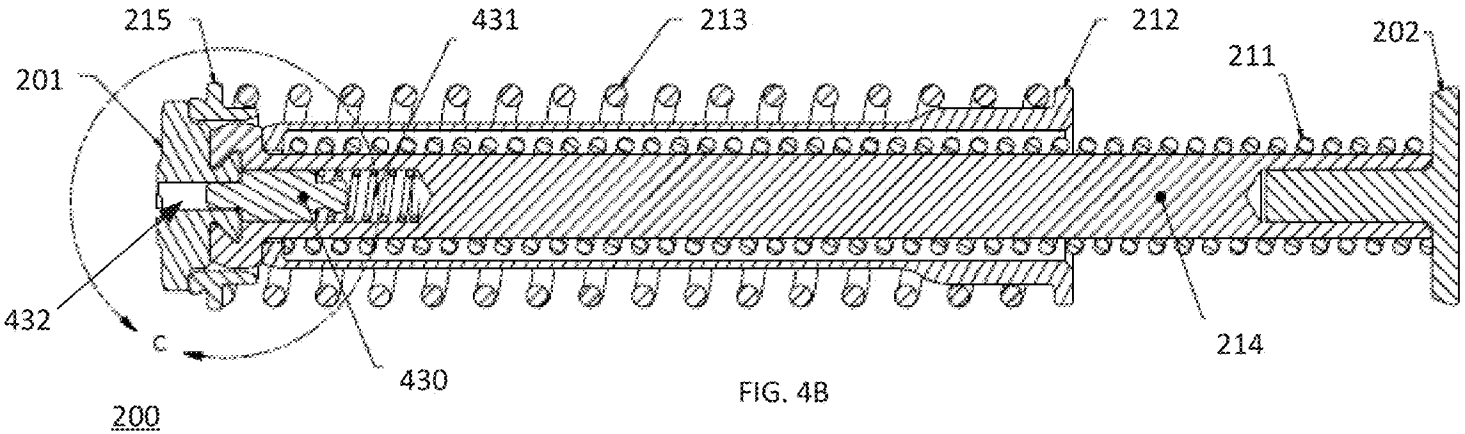
FIG. 4B illustrates a sectional view taken along section line B of FIG. 4A.

FIG. 4A illustrates a front view of the recoil assembly 200 of FIG. 2. FIG. 4B illustrates a sectional view taken along section line B of FIG. 4A. FIG. 4D illustrates a sectional view taken along section line A of FIG. 4A.

Referring to FIG. 4B, the tail cap 202 may have a cap section shaped similar to the tail cap 2 (FIG. 1), and a post to mate with the opening on the rear side of the guide rod 214. In this example, the post may press fit with the guide rod 214. The post is not required—in other examples the tail cap 202 may have some other structure for fixably attaching to the rear end of the guide rod 214.

In this embodiment, the removable cap 201 is attached to the front end of the guide rod 214 via a dovetail. In other embodiments, some other mechanism for sliding removing the removable cap 201 from the guide rod 214 may be used. Preferably, this interface is not threaded so as to not require threading adhesive and/or not back out over time from the vibrations resulting from repeated use of the recoil assembly 200 in a firearm.

A retention stud spring 431 urges part of cap retention stud 430 into a through hole 432 that extends through the removable cap 201. When the part of the cap retention stud 430 is in the through hole 432, the removable cap 201 cannot be slidingly removed from the guide rod 214. A tool (not shown) may be inserted into a front end of the through hole 432 to push the part of the retention stud 430 out of the through hole 432 (e.g., collapse the retention stud spring 431) so that the removable cap 201 may be slidingly released from the guide rod 214.

In the illustrated embodiment, the retention stud spring 431 is a metal spring. However, in various embodiments any type of spring, now known or later developed, may be used in place of the illustrated metal spring. A spring may include any object to generate a spring force, such as any elastic object that stores mechanical energy. In some embodiments, rubber may be located at a bottom of a hole to urge part of a cap retention stud into a through hole.

Figure 4C:
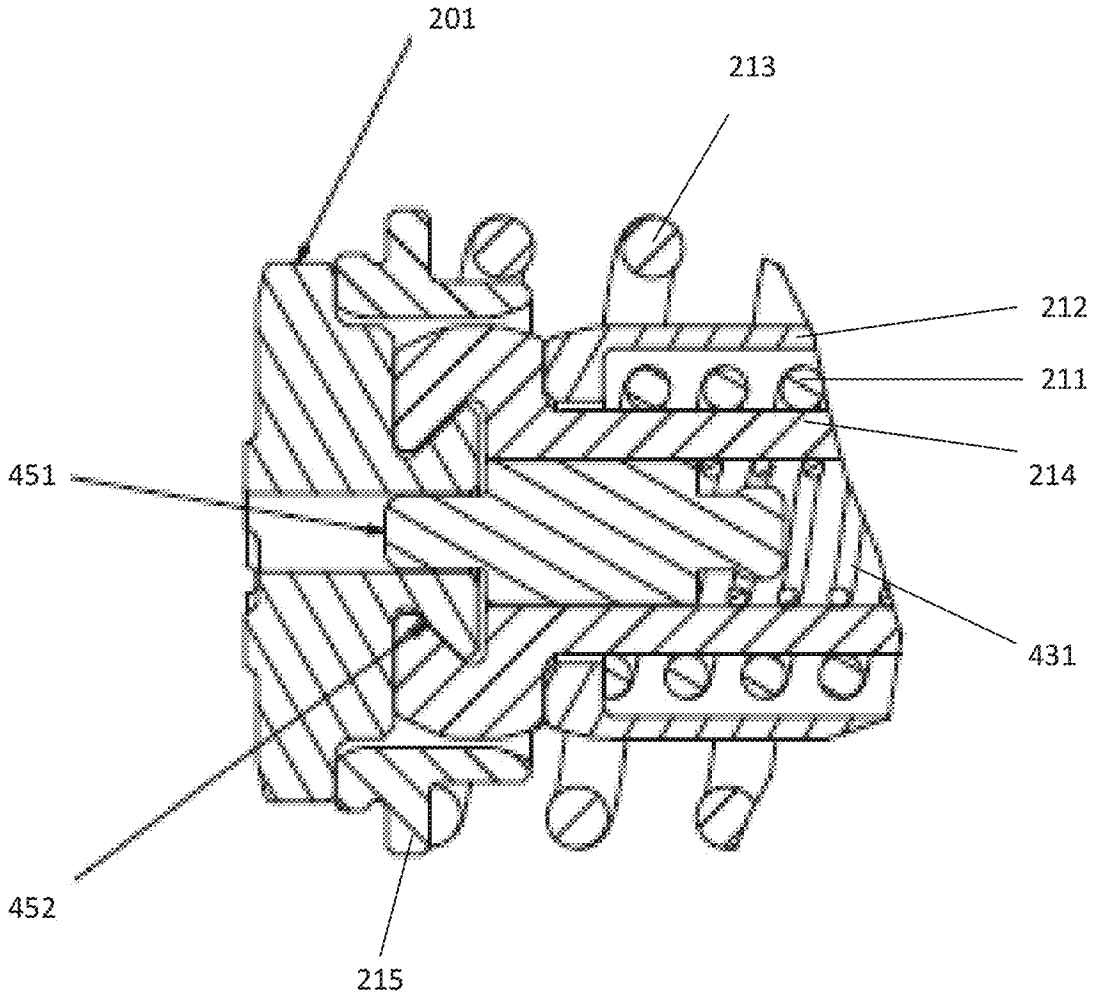
FIG. 4C illustrates a detailed view of region C of FIG. 4B.
Figure 4D:
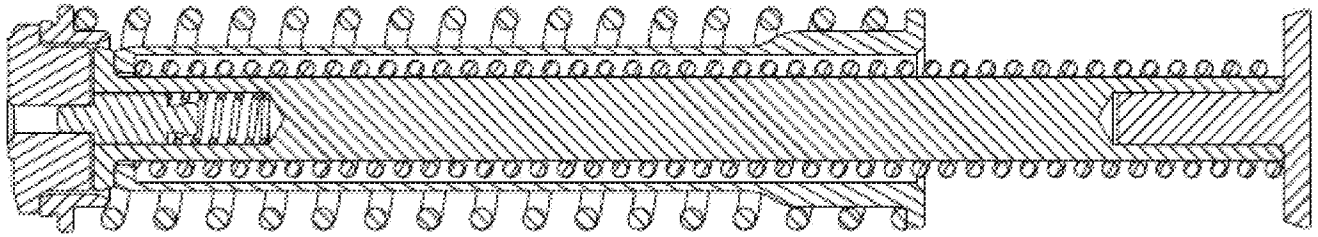
FIG. 4D illustrates a sectional view taken along section line A of FIG. 4A.

FIG. 4C illustrates a detailed view of region C of FIG. 4B. The tool (not shown) may press against the surface 451 to collapse the retention stud spring 431. In this example, a male interface 452 may be located on the removable cap 201 and the female interface may be located on the guide rod 214. In other examples, a male interface may be located on the guide rod 214 and a female interface may be located on the removable cap 201.

Referring again to FIG. 4B, a retaining bushing 215 may have the shoulders illustrated in FIG. 4B. When the slide 320 (FIG. 3B) is pulled back into a locked position, the retaining bushing 215 may collapse the outer spring 213—exposing the front end of the guide rod 214 and allowing the user to remove the removable cap 201 as described herein.

Once the removable cap 201 is detached, the user may press a slide release to unlock the slide 320 (FIG. 3B) and then release the slide assembly from the firearm. The user may then remove the guide rod assembly 200 from the slide assembly, and then slide the bushing 215 and the outer spring 213 off of the spring sleeve 212. The user may then slide a different outer spring (with a different spring weight) and the same bushing 215 onto the spring sleeve 212, and reassemble the firearm (the inner spring 211 need not replaced). The user may then use the recoil assembly 200 with the different total spring weight with the firearm. In contrast to some recoil assemblies, recoil spring replacement can be performed without pliers, vices, or other clamping tools—by operation of the retaining bushing 215, which allows the firearm's slide lock to be exploited as described above.

In various embodiments, a tunable recoil assembly may include a single recoil spring or more than one recoil spring (e.g., an outer spring and an inner spring). The recoil spring may include a round wire recoil spring in some examples. In embodiments including more than one recoil spring, one of the springs (e.g., an outer spring) may be removable from a guide rod assembly when a removable cap is released from the guide rod while the other spring remains mounted on the guide rod. In these examples, the removable spring may be replaced with a different spring to provide a different total spring weight.

Various embodiments may be arranged for use with Glocks® or any other make of firearm. In some embodiments, the tunable recoil assembly may be arranged to be interchangeable with a non-adjustable recoil assembly (such as the dual round wire spring recoil assembly in some Glocks®) without requiring a slide lug adapter bushing. However, this is not required—various embodiments may employ a single flat wire spring and may be interchangeable with the non-adjustable recoil assembly using a slide lug adapter bushing.

One application for the tunable recoil assembly described herein is with barrel-mounted accessories (including but not limited to barrel-mounted compensators) that alter the flow of gas from the front end of the firearm. In this application, the tunable recoil assembly may include a first spring having a spring weight selected based on gas flow when the barrel-mounted accessory is used and a spring weight selected based on gas flow when the barrel-mounted accessory is not used.

Figure 5A:
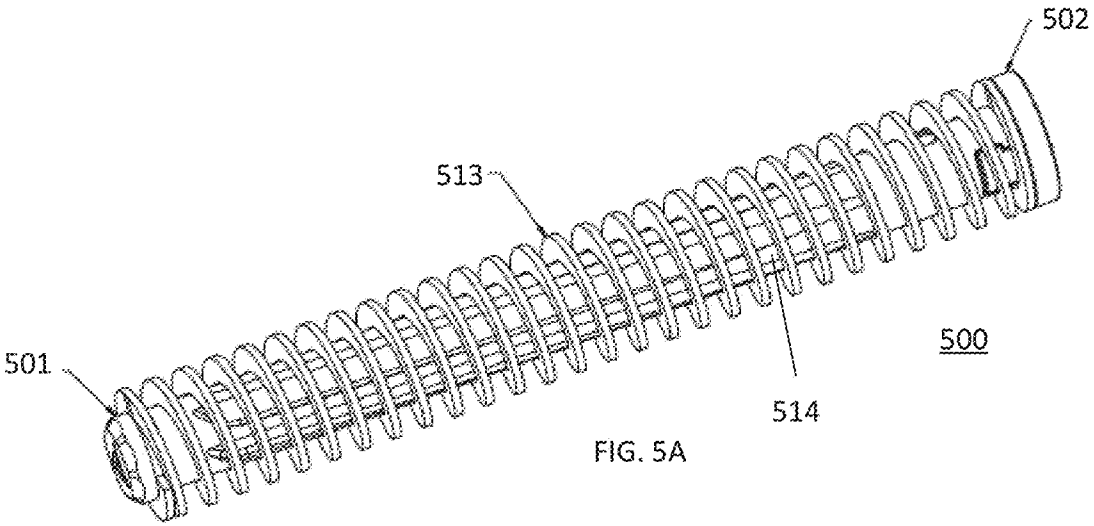
FIG. 5A is an isometric view of a single flat wire spring recoil assembly, according to various embodiments.

Tunable Recoil Assembly with Spring-End Engaging Mechanism for Retaining a Partially Collapsed State of the Spring FIG. 5A is an isometric view of a single flat wire recoil assembly 500, according to various embodiments. The illustrated embodiment may be used in place of a Glocks® generation three single flat wire spring recoil assembly (e.g., may have the same or similar outside dimensions). This single flat wire spring recoil assembly 500 may be used in other generations of Glocks® using an adapter now known or later developed (e.g., the adapter described herein that allows a single flat wire spring recoil assembly to be used in place of a dual spring recoil assembly).

The recoil assembly 500 has a removable tail cap 502 detachably (e.g., slidingly) coupled to an end of the guide rod 514. The removable tail cap 502 is retained using a back end of the recoil spring 513.

Whereas in this example the tail cap 502 is removable, the head 501 may be integrally formed on the guide rod 514. In other examples, the head 501 may include a cap connected (e.g., non-releasably coupled) to the guide rod 514, e.g., press fit into a hole formed in an end of the guide rod 514, or otherwise fixably attached thereto (a hole on the front end of the guide rod 514 may be similar in any respect to the hole 302 (FIG. 3B) on the back end of the guide rod 214). Some known single flat wire spring recoil assemblies include a removable front cap, which may be threaded into a guide rod. Vibration from using the firearm may eventually cause the screw to "back out" from the threaded hole in some designs, which may require a user to re-tighten the removable front cap.

Figure 5B:
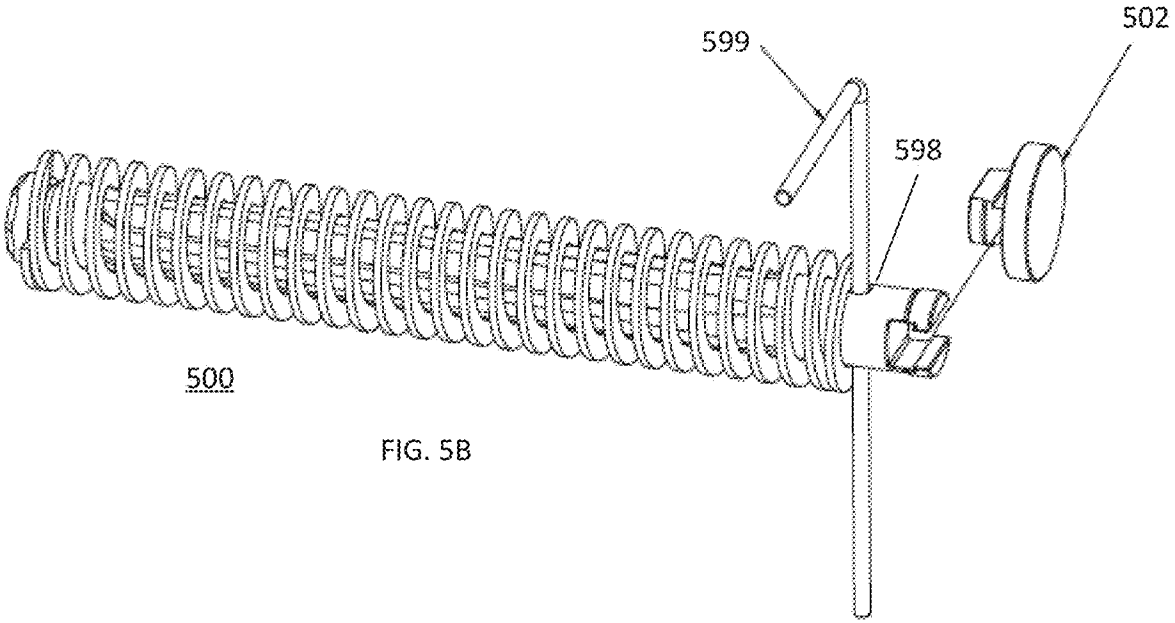
FIG. 5B is an isometric view of the recoil assembly of FIG. 5A in which the tail cap is removed.

Referring now to FIG. 5B, the recoil spring 513 may be swapped with a different recoil spring having a different spring strength, as follows. The recoil assembly 500 (FIG. 5A) may be removed from a firearm by first removing the slide assembly from the grip frame. Then, a user may pull the recoil spring 513 slightly away from the tail cap 502 to expose the through hole 598.

In various embodiments, the user may hold the recoil spring 513 back with one hand while the user re-attaches the tail cap 502 (or the user may use some sort of clamping tool to hold the recoil spring 513 back with both hands free). However, in the illustrated embodiment, the single flat spring recoil assembly 500 includes a mechanism for engaging an end of the spring 513 to lock the spring 513 in a partially collapsed state without requiring the use of a clamping tool.

In various embodiments, this mechanism may include one or more recesses in the guide rod 514 proximate to the end to receive the tail cap 502. One or more spring-end engaging devices may be insertable in the one or more recesses when the recesses are exposed by pulling back the spring 513. In various embodiments, once inserted in the one or more recesses, the one or more spring-end engaging devices may contact the end of the spring 513, e.g., opposing positions on the end of the spring 513 as illustrated.

In the illustrated example, the one or more recesses include a single through hole 598 extending from one side of the length of the guide rod 514 to an opposite side of the length of the guide rod 514. In the illustrated example, the spring-end engaging device is the tool 599. With the through hole 598, this tool 599 may be the same tool insertable in the front end of the through hole 432 (FIG. 4B). This may simplify a supply chain for a manufacturer, or may convenience a user who may have multiple firearm accessories (the tool 599 may be the same tool usable for installation of other firearm accessories such as a safety selector e.g., insertable into the receiving hole 352 of FIG. 3 of U.S. Patent Publication 2017/0176122, which is incorporated by reference herein). In other embodiments, the tool 599 may be a hex wrench that is also usable for threadingly coupling a removable cap to a guide rod, which also be convenient for a user or may provide supply chain simplification benefits.

With the tool 599 in place, the tail cap 502 is no longer retained by the back end of the recoil spring 513 (since the tool 599 contacts the end of the recoil spring 513 at the opposing positions, as illustrated). In this state, the tail cap 502 may be slidingly removed from the back end of the guide rod 514, as illustrated. FIG. 5D illustrates one example of a mating interface 592 arranged to slidingly engage the channel 591 (FIG. 5C) in the back end of the guide rod 514. In this example, the channel 591 is a T-slot and the mating interface is a T-slot interface, but in other examples the channel and the mating interface may have some other profile such as a dovetail profile.

Figure 5C:
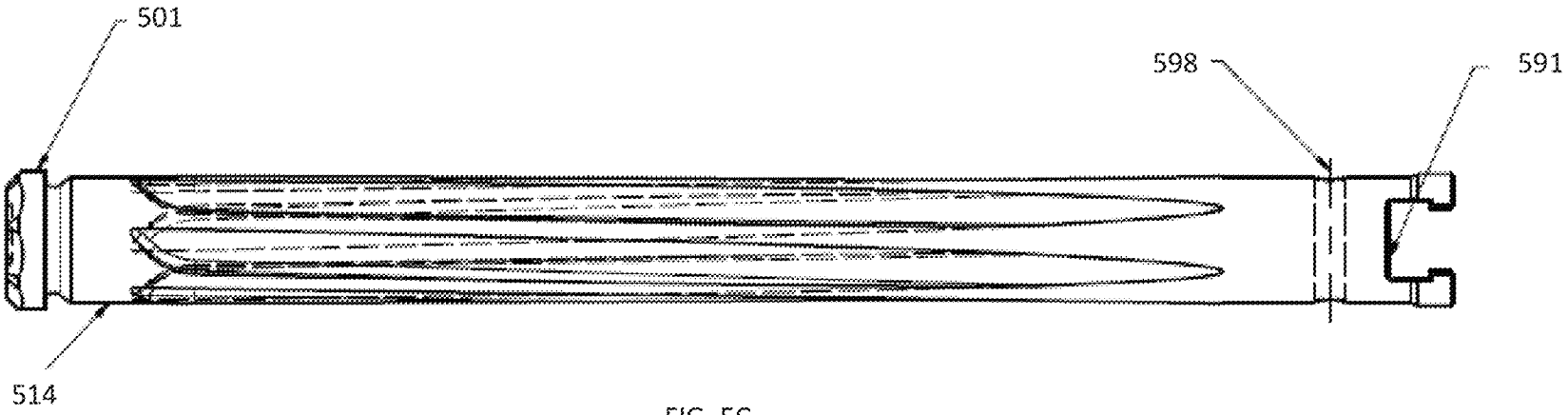
FIG. 5C is a side view of the guide rod of the recoil assembly of FIG. 5A
Figure 5D:
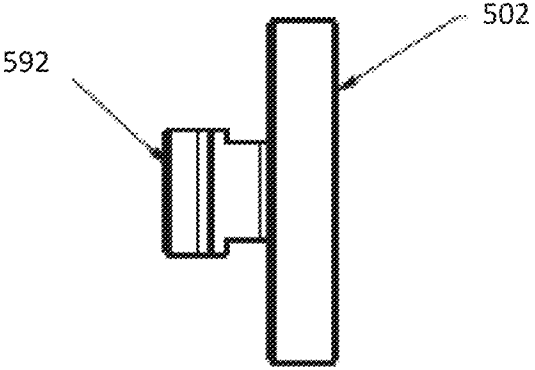
FIG. 5D is a side view (not to scale) of the tail cap of the recoil assembly of FIG. 5A.

The user may then remove the tool 599 from the through hole 598, and slide the recoil spring 513 off the guide rod 514 (FIG. 5C). The user may then slide a different recoil spring (not shown) having a different spring strength onto the guide rod 514 and reattach the removable cap 502.

Figure 6A:
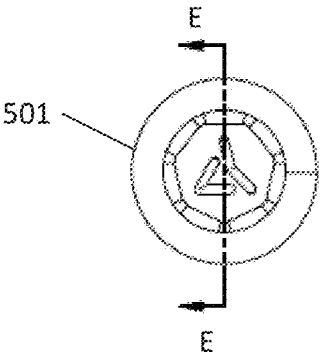
FIG. 6A illustrates a front view of the recoil assembly of FIG. 5A.
Figure 6B:
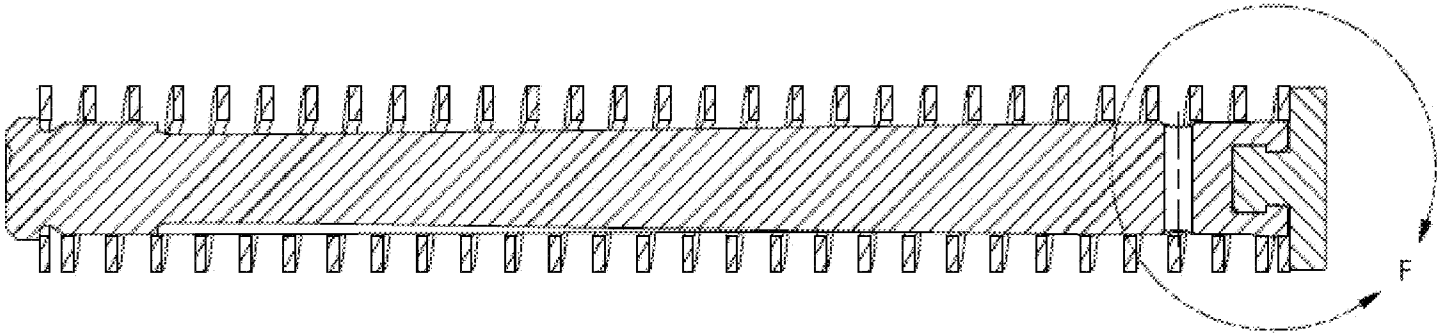
FIG. 6B illustrates a sectional view taken along section line E of FIG. 6A.
Figure 6C:
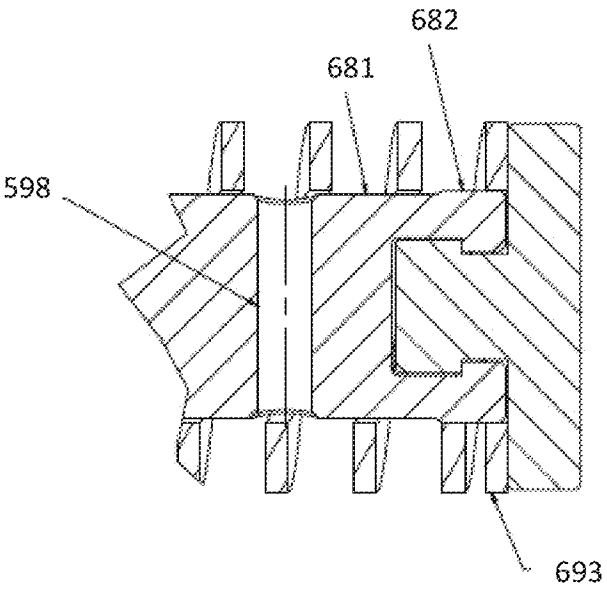
FIG. 6C illustrates a detailed view of region F of FIG. 6B.

FIG. 6A illustrates a front view of the recoil assembly 500 of FIG. 5A. FIG. 6B illustrates a sectional view taken along section line E of FIG. 6A. FIG. 6C illustrates a detailed view of region F of FIG. 6B. The guide rod 514 may include a first section 681 with a clearance diameter (for sliding off the single flat wire recoil spring) and a second section with a second greater diameter 682. A back end 693 of the single flat wire recoil spring may interference fit with the second section and/or may make contact with two opposing positions on a portion, as illustrated, of the removable tail cap (e.g., top and bottom of the tail cap, left and right sides of the tail cap, etc., particularly where the recoil spring is a flat wire recoil spring or some other type of recoil spring with a flat end to provide the contact with a flat of the removable tail cap). This may secure a position of the removable tail cap so that the tail cap is both retained on the guide rod and secured in a fixed position (e.g., no "play" while the tail cap is retainingly attached to the back end of the guide rod).

In this example, the recoil spring 513 is a single flat wire single spring, but it may be possible and practical to utilize a round wire single spring in other examples, particularly if the round wire recoil spring has a flat back end. In this example, the recoil assembly 500 is arranged for use with a Glock®, but other examples may employ any of the features described above in any make or model of firearm.

Figure 7A:
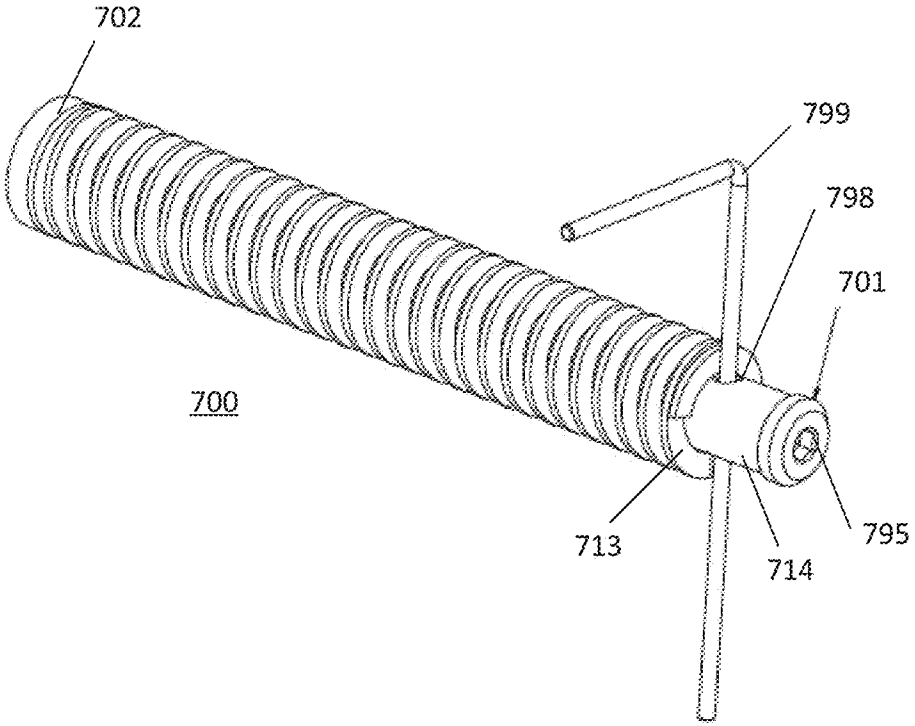
FIG. 7A is an isometric view of another single flat wire spring recoil assembly with a threaded cap on a front end, according to various embodiments.

FIG. 7A is an isometric view of another single flat wire spring recoil assembly 700 with a threaded cap on a front end 701, according to various embodiments. This recoil assembly 700 may have single flat wire recoil spring 713 that is similar in any respect to the single flat wire recoil spring 513 (FIG. 5A). A back head 702 may be integrally formed with a back end of the guide rod 714 similar to how the head 501 (FIG. 5A) may be integrally formed with the front end of the guide rod 514. Alternatively, the head 702 may include a tail cap similar to any other tail cap described herein, such as tail cap 202 (FIG. 2), in any respect.

The through hole 798 may be similar to through hole 598 (FIG. 5A), and the tool 799 may be used in any way as the tool 599 (FIG. 599). The front cap 701 may thread onto and off of the guide rod 714 to remove/replace the single flat wire recoil spring 713 (without requiring pliers and/or a vice to hold back the recoil spring 713 due to the through hole 798). A socket 795 may be used to tighten or loosen the threading.

Figure 7B:
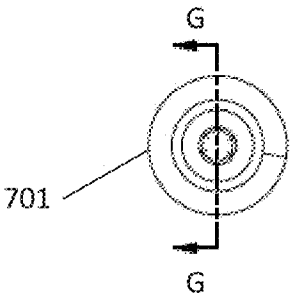
FIG. 7B is a front view of the recoil assembly of FIG. 7A.
Figure 7C:
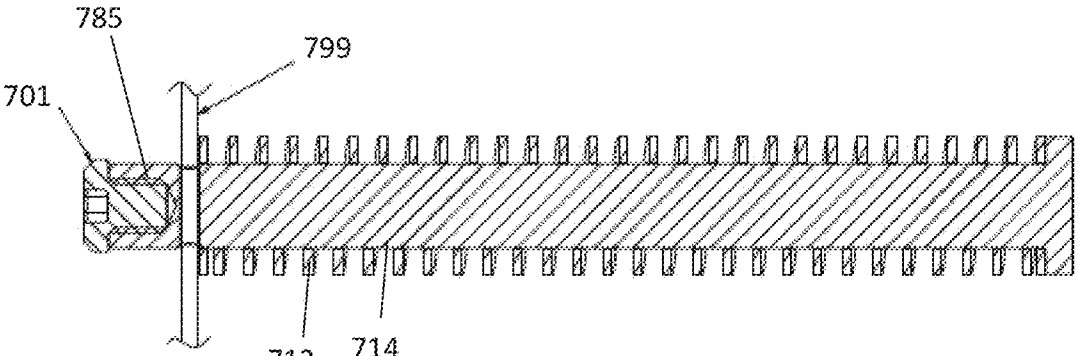
FIG. 7C illustrates a sectional view taken along section line G of FIG. 7B.

FIG. 7B is a front view of the recoil assembly 700 of FIG. 7A. FIG. 7C illustrates a sectional view taken along section line G of FIG. 7B. The front end of the guide rod 714 defines a threaded hole 785 to mate with threading on the front cap 701.

In this example, the recoil spring 713 is a single flat wire spring, but it may be possible and practical to utilize a round wire single spring in other examples. In this example, the recoil assembly 700 is arranged for use with a Glock®, but other examples may employ any of the features described above in any make or model of firearm.

Referring again to FIG. 5B, some embodiments of a dual spring recoil assembly may be arranged for interchanging both springs. These embodiments may include two releasably coupled caps (one on each end of the guide rod). In such an embodiment, the front cap may be similar in any respects to any front cap described herein, e.g., slidingly coupled to the front end of the guide rod such as front cap 201, or threadingly coupled to the front end of the guide rod such as front cap 701 (FIG. 7A). The front cap may be removed from the guide rod to replace the outer spring similar to the process described with respect to FIG. 2.

Figure 8:
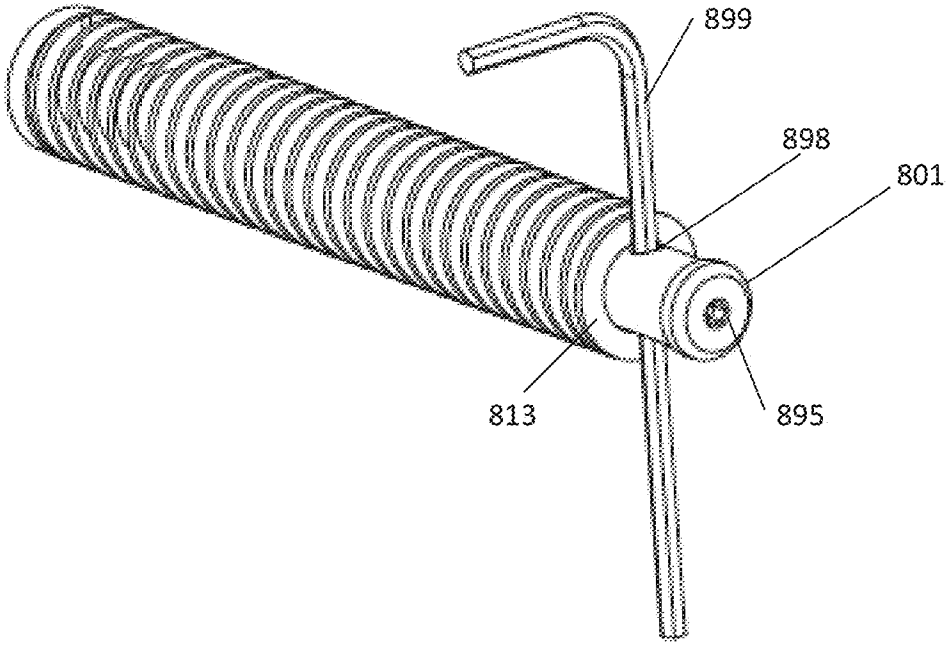
FIG. 8 is an isometric view of another single flat wire spring recoil assembly with a threaded cap on a front end, according to various embodiments.

The rear cap may be similar in any respect any spring-retained tail cap described herein, such as tail cap 502 (FIG. 5B). In such an embodiment, the spring-retained tail cap may be retained using an end of the inner spring. With the outer spring removed from the guide rod, the inner spring can be partially collapsed similar to the process described with respect to FIG. 5A to remove the tail cap from the guide rod. Then, the inner spring can be removed from the guide rod, an alternative inner spring installed, and the tail cap may then be attached and retained by the end of the new inner spring. A new outer spring may then be installed and the removable front cap may be reattached. FIG. 8 is an isometric view of another single flat wire spring recoil assembly 800 with a threaded cap 801 on a front end, according to various embodiments. The threaded cap 801 may be similar in any respect to the threaded cap 701 of FIG. 7A (and the socket 895 may be similar in any respect to the socket 795 of FIG. 7A). A hex tool 899 may be usable with the socket 895. The recoil spring 813 may be similar to the recoil spring 713 (FIG. 7A).

It should also be appreciated that any of the features of the removable front cap 201 (FIG. 2) may be employed for retaining a tail cap in various embodiments. In these embodiments, the front end of the recoil assembly may be any head, fixably attached cap, or removable cap described herein.

The through hole 898 may be similar to the through hole 798 (FIG. 7A), e.g., may be a round through hole. However, a diameter of the through hole 898 is selected so that the tool 899 may be inserted therein. In this embodiment, the hex tool 899 may be used on the socket 895 (not shown) to initially loosen the threaded cap 801 when the recoil spring 813 is in the resting state. Then a user may partially collapse the recoil spring 813 to expose the through hole 898, and then insert the hex tool 899 as illustrated to hold the recoil spring 813 in the partially collapsed state. Then, the user may finger-loosen the partially loosed threaded cap 801 the rest of the way off of the guide rod to swap out the recoil spring 813 for another recoil spring in a similar way as previously described.

Figure 9B:
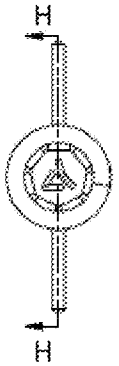
FIG. 9B illustrates a front view of the recoil assembly of FIG. 9A.
Figure 9A:
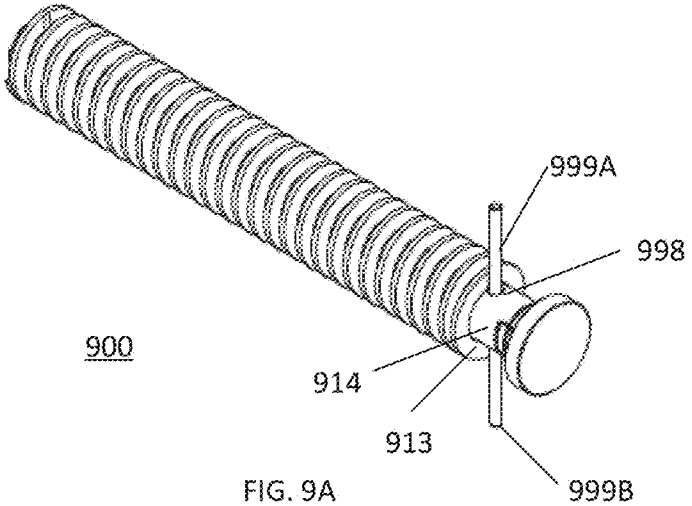
FIG. 9A is an isometric view of another single flat wire spring recoil assembly with a plurality of recesses on the guide rod, according to various embodiments.
Figure 9C:
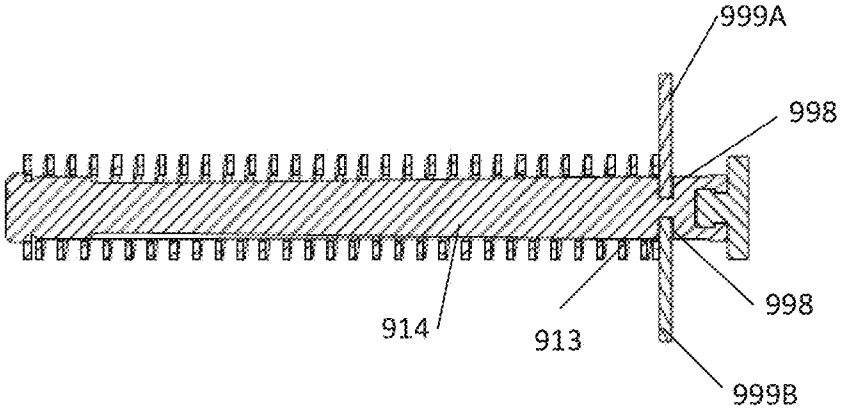
FIG. 9C illustrates a sectional view taken along section line H of FIG. 9B.

FIG. 9A is an isometric view of another single flat wire spring recoil assembly 900 with a plurality of recesses 998 on the guide rod, according to various embodiments. FIG. 9B illustrates a front view of the recoil assembly 900 of FIG. 9A. FIG. 9C illustrates a sectional view taken along section line H of FIG. 9B. Spring-end engaging devices 999A and 999B may be insertable in the recesses 998 when the recesses 998 in the guide rod 914 are exposed by pulling back the recoil spring 913. The spring-end engaging devices 999A and 999B may engage the end of the recoil spring 913 similar to how the tool 599 (FIG. 5A) holds back the recoil spring 513. Other features of the recoil assembly 900 may be similar in any respect to recoil assembly 500 (FIG. 5A) or any other recoil assembly described herein.

It may be possible and practical to use a short length for the spring-end engaging devices 999A and 999B (just long enough to engage the spring-end to retain the coil spring 913 in the partially collapsed state). However, in embodiments in which a removable cap is threadingly coupled to the guide rod, the use of longer spring-end engaging devices may provide a grip point for a user when tightening down the threading of the removable cap. In one example, a user could grip one or both of the spring-ends engaging devices 999A or 999B. This may avoid the need for the user to clamp a non-detachable surface on the recoil assembly with pliers or another clamping tool when tightening down the removable cap (which could mar the non-detachable surface of the recoil assembly). Alternatively, the illustrated length of the spring-end engaging devices may provide enough leverage for hand-gripping of the recoil assembly when tightening down the threading of a removable cap.

In one embodiment, a guide rod assembly may include a removable front cap releasably couplable to a front end of single-spring guide rod and a spring loaded plunger. In this embodiment, the tail cap may be integrally formed on the other end of the guide rod, fixably coupled to the other end of the guide rod (e.g., adhesively attached (e.g., threaded), riveted, or the like), or releasably coupled to the other end of the guide rod using any coupling mechanism described herein, now known, or later developed.

In any of the guide rod assemblies described herein, a front cap and/or a tail cap may be releasably coupled to the front or back end of the guide rod. In contrast to some known guide rod assemblies that may use threading in combination with a threadlocking adhesive (e.g., Loctite red or Loctite blue) to retain a cap to the guide rod, in various embodiments the cap(s) may be retained without an adhesive and using at least one spring of the guide rod assembly (e.g., self-captured in which the guide rod assembly captures the cap using a spring force, and without threading/adhesive). In various embodiments, the at least one spring may be a spring of one or more springs around a length of the guide rod or the spring may be some other spring such as a cap retention stud spring.

Figure 10A:
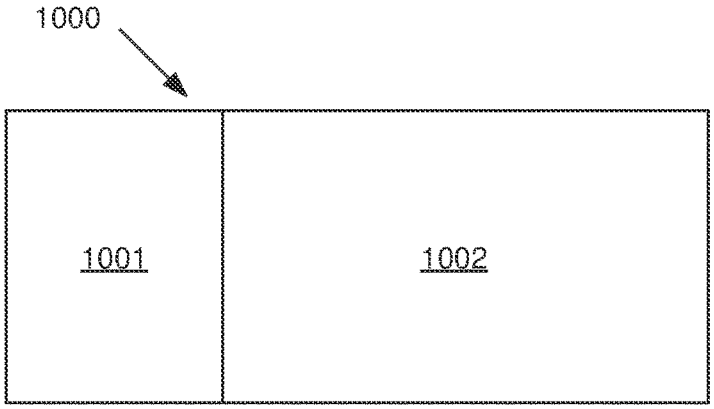
FIG. 10A is a schematic diagram of a recoil assembly having a twistingly removable cap.
Figure 10B:
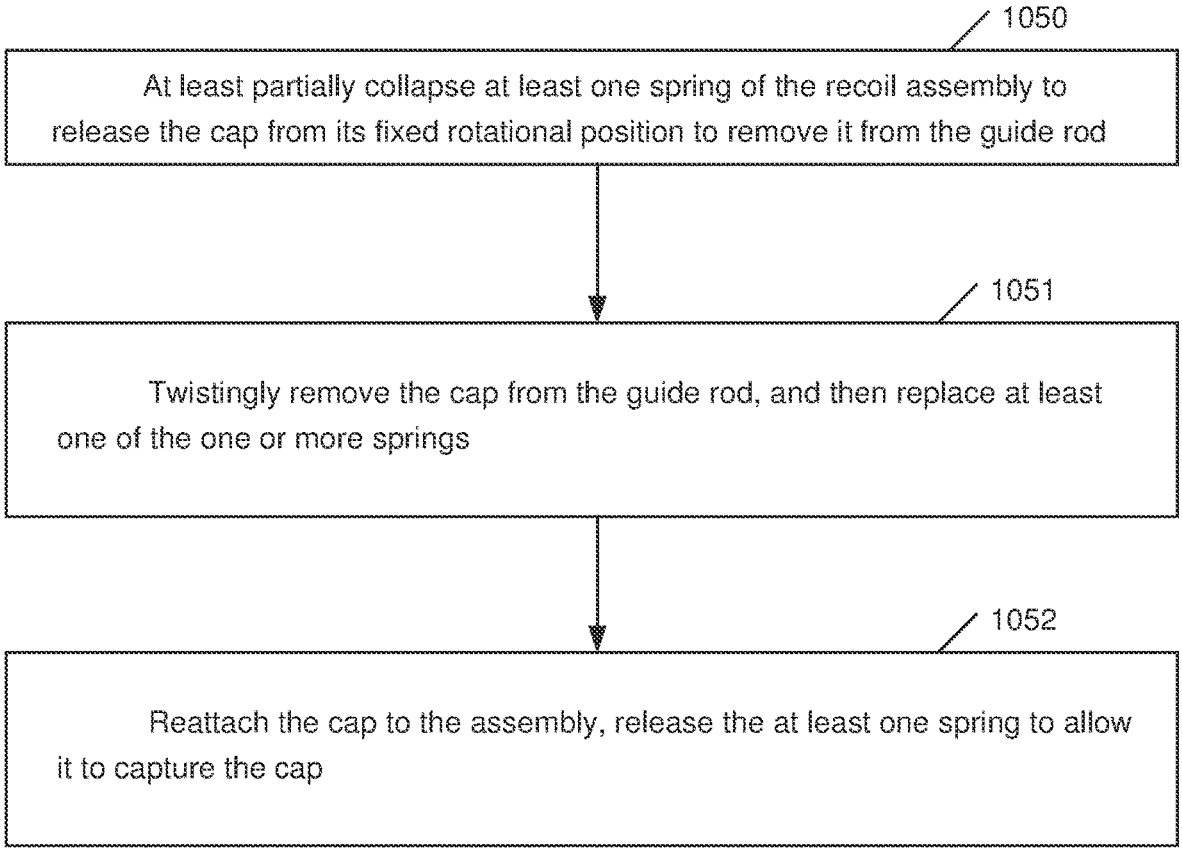
FIG. 10B illustrates a process of releasing the cap of FIG. 10A to replace a recoil spring of the recoil assembly.

In the previously described embodiments the cap(s) retained using the at least one spring may be slidingly coupled to the guide rod. However, in other examples a guide rod assembly may be arranged for twistingly coupling the cap(s) to the guide rod. For example, a twistingly coupled cap or the guide rod may include a groove arranged to fix a rotational position of the cap relative to the guide rod, and the at least one spring may retain the cap on the guide rod in the fixed rotational position. FIG. 10A is a schematic diagram of a recoil assembly 1000 including a twistingly removable cap 1001. The recoil assembly 1000 includes a twistingly removable cap 1001 releasably coupled to an assembly 1002 having a guide rod having one or more springs around its length, in which at least one spring of the recoil assembly 1000 retains the twistingly removable cap 1001 in a fixed rotational position relative to the assembly 1002. To release the cap 1001 from the assembly 1002, in block 1050 a user may at least partially collapse the at least one spring of the recoil assembly 1000 to release the cap 1001 from its fixed rotational position - in order to remove it from the guide rod. In block 1051, the user may then twistingly remove the cap 1001 from the assembly 1002, which allows a user to replace a spring of the one or more springs with a different spring (e.g., one having a greater or lesser spring weight). With the spring replaced, in block 1052 the user may then reattach the cap 1001 to the assembly 1002, and release the at least one spring to allow it to capture the cap. In various embodiments, the caps may be releasably coupled to the guide rod using any of a sliding movement, a twisting movement, and/or so other motion.

We claim all modifications and variations coming within the spirit and scope of the following claims.

The invention claimed is:

1. A recoil assembly, comprising:

a guide rod having a front end, a length, and a rear end;

one or more springs around the length of the guide rod; and a removable cap coupled to one of the ends of the guide rod, wherein the removable cap is retained on the one of the ends of the guide rod using at least one spring;

the removable cap:

1) slidingly removable along an axis that is different than a center axis of the guide rod, or 2) twistingly removable, in which the at least one spring retains the removable cap on the guide rod in a fixed rotational position.

2. The recoil assembly of claim 1, further comprising:

a head integrally formed with the other one of the ends, or an additional cap releasably or fixably attached to the other one of the ends.

3. The recoil assembly of claim 1, wherein the at least one spring comprises a spring of the one or more springs.

4. The recoil assembly of claim 1, further comprising a retaining bushing around the guide rod in front of the one or more springs, wherein the retaining bushing is arranged to engage a slide lug of a slide of a firearm to collapse at least one of the one or more springs when the slide is in a locked position.

5. The recoil assembly of claim 1, wherein the removable cap is retained on the one of the ends of the guide rod using the at least one spring, and without an adhesive.

6. The recoil assembly of claim 1, wherein the one or more springs comprises:

a single flat, or a round wire spring.

7. The recoil assembly of claim 1, wherein the one or more springs comprises a plurality of springs.

8. The recoil assembly of claim 7, wherein the plurality of springs comprises:

an outer spring around a spring sleeve that is around an inner spring;

wherein the outer spring is releasably mounted to the length of the guide rod, being retained by the removable cap.

9. The recoil assembly of claim 7, wherein the plurality of springs comprises an inner spring around the length of the guide rod and an outer spring around the inner spring, and wherein the recoil assembly further includes:

an additional removable cap coupled to the other one of the ends of the guide rod, wherein one of the removable caps comprises a tail cap retained by an end of the inner spring.

10. A kit of parts including the recoil assembly of claim 1, wherein the kit of parts further comprises:

a set of recoil springs, including a first recoil spring having a spring weight associated with firing with a gas compensation device and a second recoil spring having a different spring weight associated with firing without the gas compensation device;

wherein a spring of the one or more springs comprises the first recoil spring or the second recoil spring.

11. The kit of parts of of claim 10, wherein:

the removable cap is retained by an end of the one of the first recoil spring or the second recoil spring, or wherein the one or more springs comprises a plurality of springs including an outer spring installable around an inner spring around the length of the guide rod, and wherein the removable tail cap is retained by a back end of the inner spring.

12. A system including a firearm and a kit of parts, wherein the firearm includes the recoil assembly of claim 1, and the kit of parts includes:

a set of recoil springs, including a first recoil spring having a spring weight associated with firing with a gas compensation device and a second recoil spring having a different spring weight associated with firing without the gas compensation device;

wherein one of the first recoil spring or the second recoil spring comprises a spring of the one or more springs, and the other of the first recoil spring or the second recoil spring is a replacement spring for the spring of the one or more springs.

13. The recoil assembly of claim 1, further comprising:

a through hole to receive a retention stud; and a cap retention stud spring to urge the retention stud into the through hole.

14. A recoil assembly, comprising:

a guide rod having a front end, a length, and a rear end;

one or more springs around the length of the guide rod; and a removable cap coupled to one of the ends of the guide rod, wherein the removable cap is retained on the one of the ends of the guide rod using at least one spring;

wherein the removable cap includes a protrusion, and wherein the one of the ends defines an opening to receive the protrusion.

15. The recoil assembly of claim 14, the removable cap slidingly removable along an axis that is different than a center axis of the guide rod.

16. The recoil assembly of claim 14, the removable cap twistingly removable, in which the at least one spring retains the removable cap on the guide rod in a fixed rotational position.

17. The recoil assembly of claim 14, further comprising:

a head integrally formed with the other one of the ends, or an additional cap releasably or fixably attached to the other one of the ends.

18. The recoil assembly of claim 14, wherein the at least one spring comprises a spring of the one or more springs.

19. The recoil assembly of claim 14, further comprising a retaining bushing around the guide rod in front of the one or more springs, wherein the retaining bushing is arranged to engage a slide lug of a slide of a firearm to collapse at least one of the one or more springs when the slide is in a locked position.

20. The recoil assembly of claim 14, further comprising an additional removable cap coupled to the other one of the ends of the guide rod.

21. The recoil assembly of claim 20, wherein the one or more springs comprise an inner spring around the length of the guide rod and an outer spring around the inner spring, the outer spring being retained by the removable cap, the additional removable cap retained by a back end of the inner spring.

22. A recoil assembly, comprising:

a guide rod having a front end, a length, and a rear end;

one or more springs around the length of the guide rod;

a removable cap coupled to one of the ends of the guide rod, wherein the removable cap is retained on the one of the ends of the guide rod using at least one spring;

a through hole to receive a retention stud; and a cap retention stud spring to urge the retention stud into the through hole.

23. The recoil assembly of claim 22, wherein the at least one spring comprises the cap retention stud spring.

24. The recoil assembly of claim 22, wherein the cap retention stud spring is located in a hole in the one of the ends of the guide rod.

25. A recoil assembly, comprising:

a guide rod having a front end, a length, and a rear end;

one or more springs around the length of the guide rod;

a removable cap coupled to one of the ends of the guide rod, wherein the removable cap is retained on the one of the ends of the guide rod using at least one spring;

a female undercut interface on the one of the ends or on the removable cap; and wherein the other one of the removable cap or the one of the ends includes a protrusion to mate with the female undercut interface.

26. The recoil assembly of claim 25, the removable cap slidingly removable along an axis that is different than a center axis of the guide rod.

27. The recoil assembly of claim 25, the removable cap twistingly removable, in which the at least one spring retains the removable cap on the guide rod in a fixed rotational position.

28. The recoil assembly of claim 25, further comprising:

a head integrally formed with the other one of the ends, or an additional cap releasably or fixably attached to the other one of the ends.

29. The recoil assembly of claim 25, wherein the at least one spring comprises a spring of the one or more springs.

30. The recoil assembly of claim 25, further comprising a retaining bushing around the guide rod in front of the one or more springs, wherein the retaining bushing is arranged to engage a slide lug of a slide of a firearm to collapse at least one of the one or more springs when the slide is in a locked position.

31. The recoil assembly of claim 25, further comprising an additional removable cap coupled to the other one of the ends of the guide rod.

32. The recoil assembly of claim 31, wherein the one or more springs comprise an inner spring around the length of the guide rod and an outer spring around the inner spring, the outer spring being retained by the removable cap, the additional removable cap retained by a back end of the inner spring.

33. An apparatus, comprising:

a recoil assembly including:

a guide rod having a front end, a length, and a rear end;

one or more springs around the length of the guide rod; and a removable cap coupled to one of the ends of the guide rod, wherein the removable cap is retained on the one of the ends of the guide rod using a spring force;

wherein the removable cap or the one of the ends defines an opening, and the other one of the removable cap or the one of the ends includes a protrusion to mate with the opening.

34. A kit of parts including the recoil assembly of claim 33, wherein the kit of parts further comprises:

a set of recoil springs, including a first recoil spring having a spring weight associated with firing with a gas compensation device and a second recoil spring having a different spring weight associated with firing without the gas compensation device;

wherein a spring of the one or more springs comprises the first recoil spring or the second recoil spring; and means for engaging opposing positions on an end of the spring of the one or more springs to retain the spring of the one or more springs in a partially collapsed state for separating the removable cap from the guide rod.

35. The apparatus of claim 33, the removable cap slidingly removable along an axis that is different than a center axis of the guide rod.

36. The apparatus of claim 33, the removable cap twistingly removable, in which the spring force retains the removable cap on the guide rod in a fixed rotational position.

37. The apparatus of claim 33, further comprising:

a head integrally formed with the other one of the ends, or an additional cap releasably or fixably attached to the other one of the ends.

38. The apparatus of claim 33, wherein the spring force is provided by a spring of the one or more springs.

39. The apparatus of claim 33, further comprising a retaining bushing around the guide rod in front of the one or more springs, wherein the retaining bushing is arranged to engage a slide lug of a slide of a firearm to collapse at least one of the one or more springs when the slide is in a locked position.

40. The apparatus of claim 33, further comprising an additional removable cap coupled to the other one of the ends of the guide rod.

41. The apparatus of claim 40, wherein the one or more springs comprise an inner spring around the length of the guide rod and an outer spring around the inner spring, the outer spring being retained by the removable cap, the additional removable cap retained by a back end of the inner spring.

42. A firearm incorporating the recoil assembly of claim 33.

43. The firearm of claim 42, further comprising a gas compensation device.

* * * * *